United States Patent [19]

Schneider

[11] 4,039,891

[45] Aug. 2, 1977

[54] INCANDESCENT DISPLAY LAMP

[75] Inventor: Philip A. Schneider, Ringwood, N.J.

[73] Assignee: Refac Technology Development Corporation, New York, N.Y.

[21] Appl. No.: 674,370

[22] Filed: Apr. 7, 1976

[51] Int. Cl.[2] ..... H01K 1/22; H01K 1/40; H01K 1/42

[52] U.S. Cl. ..... 313/522; 313/220; 313/316; 313/318

[58] Field of Search ..... 313/513, 316, 522, 318, 313/220

[56] References Cited

U.S. PATENT DOCUMENTS

| | | | |
|---|---|---|---|
| 2,398,968 | 4/1946 | Singer | 313/114 |
| 3,408,523 | 10/1968 | Demarest et al. | 313/522 |
| 3,743,880 | 7/1973 | Demarest | 313/522 |

OTHER PUBLICATIONS

"Materials and Techniques for Electron Tubes," by Walter H. Kohl, 1962, pp. 394–397.

*Primary Examiner*—Palmer C. Demeo

*Attorney, Agent, or Firm*—Lerner, David, Littenberg & Samuel

[57] ABSTRACT

A glass incandescent display lamp is provided which includes a glass container and a glass faceplate forming a sealed glass envelope enclosing an evacuated space. A plurality of electrically-conductive filament posts having first and second ends is provided with the filament posts extending through a wall of the glass envelope so that the first ends terminate in the evacuated space, and the second ends terminate outside of the sealed glass envelope. A set of incandescent filaments is secured to the first ends of the filament posts for the passage of current and for producing a display. In addition, a plurality of conductor pins for connecting the filaments to an external source of power is provided with each of the conductor pins having one end embedded in the wall of the glass envelope and the other end extending to the exterior of the sealed glass envelope. In order to provide strain relief for the filament posts and in order to prevent breaking of the hermetic seal, the second ends of the filament posts are connected to the portion of the conductor pins which are outside of the sealed glass envelope.

4 Claims, 4 Drawing Figures

INCANDESCENT DISPLAY LAMP

FIELD OF THE INVENTION

The present invention relates generally to incandescent display lamps and, specifically, to an improved incandescent display lamp for displaying numeric or alpha-numeric readouts which includes a novel glass construction which reduces the cost of manufacture and assmebly, and wherein the filament posts are connected to the conductor pins to provide a strain relief for the filament posts and to prevent breaking of the lamp's hermetic seal.

BACKGROUND OF THE INVENTION

Incandescent filament lamps are well known and commonly used in alpha-numeric displays. In addition, a number of different constructions and arrangement have been developed for the sealed envelope and the manner in which the filament posts and conductor pins are connected to and arranged with respect to the sealed envelope. For example, as shown in U.S. Pat. No. 2,139,762, it is well known in the incandescent lamp industry to terminate filament posts on a support structure after the filament posts pass through a glass seal. It is also common in the construction of directly viewed incandescent displays to provide for a transition from a conductor pin to a pattern of filament posts. Such an arrangment is disclosed in U.S. Pat. No. 3,743,880 in which a printed circuit board is mounted inside the sealed lamp and provides a connection between the inner filament posts and the outer conductor pins.

U.S. Pat. No. 2,398,968 also discloses another arrangement for connecting the filament posts to the conductor pins. In this patent, the filament posts extend outside of the sealed envelope and are connected to the conductor pins. However, the conductor pins are positioned in grooves formed between the lamp plug and the walls of the lamp. Accordingly, as the pins are not integrally formed with the lamp or plug, relative movement is possible, and continued plugging and unplugging of the conductor pins of such a lamp will eventually cause the hermetic seal of the lamp to be weakened.

There have also been attempts in the prior art to construct a directly-viewed, all-glass incandescent lamp in order to reduce the cost of manufacture and assembly. In such incandescent displays, the filament posts pass directly through a glass wall of the sealed envelope to the outside of the envelope where the ends of the posts are bent to form conductor pins according to the required pin pattern. In this manner, the ends of the filament posts outside of the glass envelope serve as the conductor pins. However, such incandescent displays have the drawback that use of the conductor pins causes movement of the filament posts relative to the glass which results in leakage at the glass to metal seal.

As the foregoing arrangement was not effective in preventing leakage of the hermetic seal, more recently, another arrangement was attempted, as disclosed in Reissue U.S. Pat. No. 27,949, assigned to the same assignee as the present application. In this arrangement, a metal base is provided in a plastic housing which has conductor pins embedded therein to form a pin pattern. Filament posts are mounted in the metal base by the use of glass compression seals, and the ends of the filament posts extend outside of the sealed envelope and are connected to the conductor pins, such as by welding. Although such a construction provides strain relief for the seals since the conductor pins bear the strain, such a construction is costly to manufacture, since it involves employing a metal base disposed within a plastic housing. In addition, in such a construction, a compression seal is employed between the glass surrounding the filament posts and the metal base. Therefore, it is not possible to use such a construction in an all-glass arrangement which does not include a metal base, as there would be no metal to provide the compression seal.

Broadly, it is an object of the present invention to provide an improved incandescent display lamp which overcomes one or more of the aforesaid problems. Specifically, it is within the contemplation of the present invention to provide an incandescent display lamp which is constructed of only glass and which greatly reduces the cost of manufacture and assembly, while at the same time providing strain relief to prevent weakening of the seals.

SUMMARY OF THE INVENTION

Briefly, in accordance with the principles of this invention, an improved glass incandescent display lamp is provided which includes a glass container and a glass faceplate forming a sealed glass envelope enclosing an evacuated space. a plurality of electrically-conductive filament posts having first and second ends are also provided, with the filament posts extending through a glass wall of the envelope so that the first ends terminate in the evacuated space, and the second ends terminate outside of the glass envelope. A set of incandescent filaments is selectively secured to the first ends of the filament posts inside the glass envelope for the passage of current and for producing a display. In addition, a plurality of conductor pins for connecting the incandescent filaments to an external source of power are provided. The conductor pins each have one end embedded in a glass wall of the envelope and the other end of the pin extending to the exterior of the glass envelope. The second ends of the filament posts outside of the glass envelope are connected to a portion of the conductor pins extending outside of the glass envelope so that the incandescent filaments are connected by the filament posts to the conductor pins and to an external source of power.

Advantageously, such an all-glass incandescent display lamp reduces the cost of manufacture and assembly particularly with respect to prior art arrangements which employed the use of a metal base disposed in a plastic housing, as described above. In addition, as the ends of the filament posts are not themselves employed as the conductor pins, as in the prior art arrangements described above, the strain is relieved from the filament posts, and the conductor pins receive substantially all the strain. In this manner, the glass-to-metal seal between the filament posts and the glass wall of the envelope is not strained and thereby prevents weakening or breaking of the hermetically-sealed glass envelope. In addition, the present construction avoids the use of a compression seal which was employed in prior art devices in order to provide a strong hermetic seal. In the present construction, a match seal is employed between the filament posts and the glass envelope, and it is only necessary to match the coefficients of expansion and contraction of the filament posts and glass in order to provide a strong hermetic seal.

BRIEF DESCRIPTION OF THE DRAWINGS

Further objects, features, and advantages of the present invention will become apparent upon the consideration of the following detailed description of a presently-preferred embodiment when taken in conjunction with the accompanying drawings, wherein.

DETAILED DISCUSSION OF PREFERRED EMBODIMENT OF THE INVENTION

Figure 1:
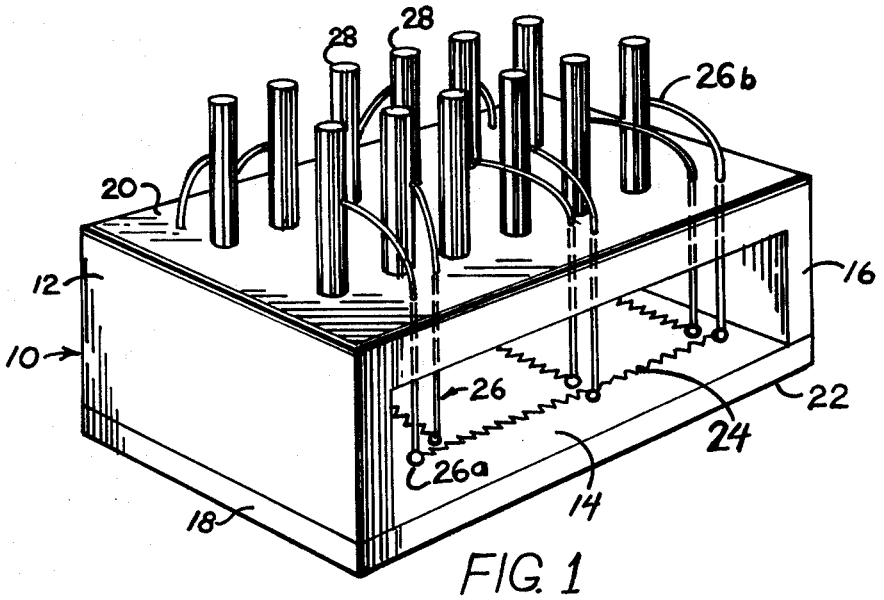
FIG. 1 is a perspective view of an incandescent display lamp embodying the features of the present invention.
Figure 2:
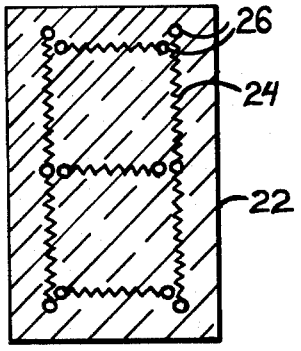
FIG. 2 is a plan view of the lamp showing the positions of the filament posts and the arrangement of the incandescent filaments.
Figure 3:
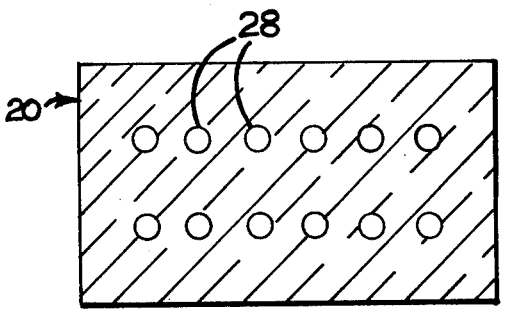
FIG. 3 is a plan view of the lamp showing the positions of the conductor pins.
Figure 4:
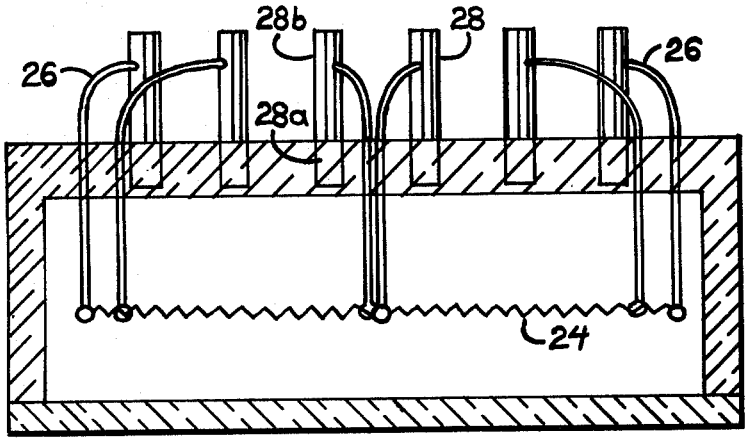
FIG. 4 is a cross-sectional view of FIG. 1 illustrating the filament posts extending through the faceplate of the glass envelope and the conductor pins embedded in the faceplate of the glass envelope.

Referring now to FIG. 1, there is shown the improved incandescent display lamp of the present invention, generally designated by the reference numeral 10, which includes a sealed envelope 12 enclosing an evacuated space 14, which may be evacuated in a conventional manner. Glass envelope 12 is formed from a glass container 16 and a glass faceplate 18. In addition glass envelope 12 includes a bottom wall 20 and a top wall 22. Faceplate 18 may be suitably sealed to glass container 16, or alternatively, container 16 and faceplate 18 may be integrally formed.

Inside glass envelope 12, there is provided a plurality of incandescent filaments 24 which may be formed of tungsten wire having their ends selectively secured to the ends of filament posts 26 for the passage of current and for producing a display through glass top wall 22. The display may be of the numeric or alpha-numeric type.

Filament posts 26 are electrically conductive and are preferably formed of metal, and each post 26 has a first end **26*a* and a second end 26*b*. Filament posts 26 extend through glass faceplate 18 with ends 26*a* terminating in evacuated space 14 and second ends 26*b* terminating outside of glass envelope 12. Filament posts 26, which are made of metal, are sealed to glass faceplate 18 by a sealing process referred to as match sealing. More particularly, the coefficients of expansion and contraction of the filament posts 26 and the glass are matched so that when the lamp is subjected to heating or cooling, the metal and glass will expand or contract at the same rate, thereby maintaining the hermetic seal of the glass envelope 12**.

A plurality of conductor pins 28 are also provided by connecting the incandescent filaments 24 and the filament posts 26 to an external source of power. Accordingly, conductor pins 28 may be plugged into any suitable source of power. Each of the conductor pins 28 has one end **28*a* embedded in glass faceplate 18, and the remaining portion 28*b* extends away from faceplate 18 to the exterior of glass envelope 12**.

As shown most clearly in the drawings, ends **26*b* of filament posts 26 are each connected to the portion 28*b* of the conductor pins 28 which extend outside of the glass envelope 12 so that the electrical connection between incandescent filaments 24, filament posts 26, and conductor pins 28 to an external source of power is complete. In this manner, current will pass through the incandescent filaments 24 and produce a numeric or alpha-numeric display visible through top wall 22 in a conventional manner. Filament post ends 26*b* may be electrically connected to conductor pins 28*b*** in any suitable manner, such as by welding.

In view of the foregoing, it will be realized that the present invention provides a completely glass incandescent display lamp which substantially reduces the cost of manufacture and assembly for such devices, as it eliminates the need for prior art arrangements in which metal bases supporting the filament posts were disposed in a plastic housing supporting the conductor pins. In addition, in the construction of the present invention, the strain of plugging and unplugging is relieved from the filament posts and the conductor pins serve this purpose. As a result, such strain relief for the filament posts avoids the problem of weakening or breaking of the hermetic seal experienced in prior art arrangements wherein the ends of the filament posts outside of the glass envelope served as the conductor pins.

A latitude of modification, change, and substitution is intended in the foregoing disclosure and, in some instances, some features of the invention will be employed without a corresponding use of other features. Accordingly, it is appropriate that the appended claims be construed broadly and in a manner consistent with the spirit and scope of the invention herein.

What is claimed is:

1. A glass incandescent display lamp comprising:

a glass container and a glass faceplate forming a sealed glass envelope enclosing an evacuated space, said glass envelope having a bottom wall;

a plurality of electrically-conductive filament posts having first and second ends, said filament posts extending through said glass bottom wall with said first ends terminating in said evacuated space and said second ends terminating outside of said glass envelope;

a set of incandescent filaments selectively secured to the first ends of said filament posts for the passage of current and for producing a display;

a plurality of conductor pins for connecting said incandescent filaments to an external source of power, said conductor pins each having one end embedded in and terminating in the bottom wall of said glass envelope and the other end of said pin extending to the exterior of said glass envelope; and the second ends of said filament posts being connected to a portion of said conductor pins extending outside of said glass envelope.

2. A glass incandescent display lamp in accordance with claim 1 wherein the second ends of said filament posts are connected to said conductor pins by welding.

3. A glass incandescent display lamp in accordance with claim 1 wherein said filament posts and said conductor pins are arranged in a predetermined pattern.

4. A glass incandescent display lamp in accordance with claim 1 wherein said filament posts are sealed to said glass bottom wall by match seals wherein the coefficients of expansion and contraction of said filament posts and said glass are matched.

* * * * *